US008210804B2

(12) United States Patent
Maier et al.

(10) Patent No.: US 8,210,804 B2
(45) Date of Patent: Jul. 3, 2012

(54) SLIDABLE COVER FOR CASING ACCESS PORT

(75) Inventors: William C. Maier, Almond, NY (US); Daniel J. Griffin, Enfield, CT (US)

(73) Assignee: Dresser-Rand Company, Olean, NY (US)

( * ) Notice: Subject to any disclaimer, the term of this patent is extended or adjusted under 35 U.S.C. 154(b) by 698 days.

(21) Appl. No.: 12/407,909

(22) Filed: Mar. 20, 2009

(65) Prior Publication Data

US 2010/0239419 A1 Sep. 23, 2010

(51) Int. Cl.
*F04D 29/40* (2006.01)

(52) U.S. Cl. ..... 415/201; 415/229; 415/230; 415/231

(58) Field of Classification Search ..... 415/126, 415/201, 229, 230, 231
See application file for complete search history.

(56) References Cited

U.S. PATENT DOCUMENTS

| | | | |
|---|---|---|---|
| 815,812 | A | 3/1906 | Gow |
| 1,057,613 | A | 4/1913 | Baldwin |
| 1,061,656 | A | 5/1913 | Black |
| 1,480,775 | A | 1/1924 | Marien |
| 1,622,768 | A | 3/1927 | Cook et al. |
| 1,642,454 | A | 9/1927 | Malmstrom |
| 2,006,244 | A | 6/1935 | Kopsa |
| 2,300,766 | A | 11/1942 | Baumann |
| 2,328,031 | A | 8/1943 | Risley |
| 2,345,437 | A | 3/1944 | Tinker |
| 2,602,462 | A | 7/1952 | Barrett |
| 2,811,303 | A | 10/1957 | Ault et al. |
| 2,836,117 | A | 5/1958 | Lankford |
| 2,868,565 | A | 1/1959 | Suderow |
| 2,897,917 | A | 8/1959 | Hunter |
| 2,932,360 | A | 4/1960 | Hungate |
| 2,954,841 | A | 10/1960 | Reistle |
| 3,044,657 | A | 7/1962 | Horton |
| 3,191,364 | A | 6/1965 | Sylvan |
| 3,198,214 | A | 8/1965 | Lorenz |
| 3,204,696 | A | 9/1965 | De Priester et al. |
| 3,213,794 | A | 10/1965 | Adams |
| 3,220,245 | A | 11/1965 | Van Winkle |
| 3,273,325 | A | 9/1966 | Gerhold |
| 3,352,577 | A | 11/1967 | Medney |

(Continued)

FOREIGN PATENT DOCUMENTS

| | | |
|---|---|---|
| CA | 2647511 | 10/2007 |

(Continued)

OTHER PUBLICATIONS

PCT/US2007/008149 International Preliminary Report on Patentability dated Sep. 30, 2008.

(Continued)

*Primary Examiner* — Igor Kershteyn
(74) *Attorney, Agent, or Firm* — Edmonds & Nolte, PC

(57) ABSTRACT

A closure device for a casing having at least one access opening wherein the closure device includes a cover member movably disposed within an interior chamber of the casing so as to be slidably displaceable along or in the direction of a casing central axis between an open and a closed position, the cover member being spaced at least partially axially from the access opening in the open position so as to permit access to the interior chamber and generally extending across and substantially obstructing the at least one access opening in the closed position.

17 Claims, 3 Drawing Sheets

U.S. PATENT DOCUMENTS

| | | | | |
|---|---|---|---|---|
| 3,395,511 | A | | 8/1968 | Akerman |
| 3,420,434 | A | | 1/1969 | Swearingen |
| 3,431,747 | A | | 3/1969 | Hasheimi et al. |
| 3,454,163 | A | | 7/1969 | Read |
| 3,487,432 | A | | 12/1969 | Jenson |
| 3,490,209 | A | | 1/1970 | Fernandes et al. |
| 3,500,614 | A | | 3/1970 | Soo |
| 3,578,342 | A | | 5/1971 | Satterthwaite et al. |
| 3,628,812 | A | | 12/1971 | Larraide et al. |
| 3,672,733 | A | | 6/1972 | Arsenius et al. |
| 3,814,486 | A | | 6/1974 | Schurger |
| 3,829,179 | A | | 8/1974 | Kurita et al. |
| 3,915,673 | A | | 10/1975 | Tamai et al. |
| 3,975,123 | A | | 8/1976 | Schibbye |
| 4,033,647 | A | | 7/1977 | Beavers |
| 4,059,364 | A | | 11/1977 | Anderson et al. |
| 4,078,809 | A | | 3/1978 | Garrick et al. |
| 4,087,261 | A | | 5/1978 | Hays |
| 4,103,899 | A | | 8/1978 | Turner |
| 4,112,687 | A | | 9/1978 | Dixon |
| 4,117,359 | A | | 9/1978 | Wehde |
| 4,135,542 | A | | 1/1979 | Chisholm |
| 4,141,283 | A | | 2/1979 | Swanson et al. |
| 4,146,261 | A | | 3/1979 | Edmaier et al. |
| 4,165,622 | A | | 8/1979 | Brown, Jr. |
| 4,174,925 | A | | 11/1979 | Pfenning et al. |
| 4,182,480 | A | | 1/1980 | Theyse et al. |
| 4,197,990 | A | | 4/1980 | Carberg et al. |
| 4,205,927 | A | | 6/1980 | Simmons |
| 4,227,373 | A | | 10/1980 | Amend et al. |
| 4,258,551 | A | | 3/1981 | Ritzi |
| 4,259,045 | A | | 3/1981 | Teruyama |
| 4,278,200 | A | | 7/1981 | Gunnewig |
| 4,298,311 | A | | 11/1981 | Ritzi |
| 4,333,748 | A | | 6/1982 | Erickson |
| 4,334,592 | A | | 6/1982 | Fair |
| 4,336,693 | A | | 6/1982 | Hays et al. |
| 4,339,923 | A | | 7/1982 | Hays et al. |
| 4,347,900 | A | | 9/1982 | Barrington |
| 4,363,608 | A | | 12/1982 | Mulders |
| 4,374,583 | A | | 2/1983 | Barrington |
| 4,375,975 | A | | 3/1983 | McNicholas |
| 4,382,804 | A | | 5/1983 | Mellor |
| 4,384,724 | A | | 5/1983 | Derman et al. |
| 4,391,102 | A | | 7/1983 | Studhalter et al. |
| 4,396,361 | A | | 8/1983 | Fraser |
| 4,432,470 | A | | 2/1984 | Sopha |
| 4,438,638 | A | | 3/1984 | Hays et al. |
| 4,441,322 | A | | 4/1984 | Ritzi |
| 4,442,925 | A | | 4/1984 | Fukushima et al. |
| 4,453,893 | A | | 6/1984 | Hutmaker |
| 4,463,567 | A | | 8/1984 | Amend et al. |
| 4,468,234 | A | | 8/1984 | McNicholas |
| 4,471,795 | A | | 9/1984 | Linhardt |
| 4,477,223 | A | | 10/1984 | Giroux |
| 4,502,839 | A | | 3/1985 | Maddox et al. |
| 4,511,309 | A | | 4/1985 | Maddox |
| 4,531,888 | A | | 7/1985 | Buchelt |
| 4,536,134 | A | | 8/1985 | Huiber |
| 4,541,531 | A | | 9/1985 | Brule |
| 4,541,607 | A | | 9/1985 | Hotger |
| 4,573,527 | A | | 3/1986 | McDonough |
| 4,574,815 | A | | 3/1986 | West et al. |
| 4,648,806 | A | | 3/1987 | Alexander |
| 4,687,017 | A | | 8/1987 | Danko et al. |
| 4,737,081 | A | | 4/1988 | Nakajima et al. |
| 4,752,185 | A | | 6/1988 | Butler et al. |
| 4,807,664 | A | | 2/1989 | Wilson et al. |
| 4,813,495 | A | | 3/1989 | Leach |
| 4,821,737 | A | | 4/1989 | Nelson |
| 4,826,403 | A | | 5/1989 | Catlow |
| 4,830,331 | A | | 5/1989 | Vindum |
| 4,832,709 | A | | 5/1989 | Nagyszalanczy |
| 4,904,284 | A | | 2/1990 | Hanabusa |
| 4,913,619 | A | * | 4/1990 | Haentjens et al. ..... 415/172.1 |
| 4,984,830 | A | | 1/1991 | Saunders |
| 5,007,328 | A | | 4/1991 | Otterman |
| 5,024,585 | A | | 6/1991 | Kralovec |
| 5,043,617 | A | | 8/1991 | Rostron |
| 5,044,701 | A | | 9/1991 | Watanabe et al. |
| 5,045,046 | A | | 9/1991 | Bond |
| 5,054,995 | A | | 10/1991 | Kaseley et al. |
| 5,064,452 | A | | 11/1991 | Yano et al. |
| 5,080,137 | A | | 1/1992 | Adams |
| 5,190,440 | A | | 3/1993 | Maier et al. |
| 5,202,024 | A | | 4/1993 | Andersson et al. |
| 5,202,026 | A | | 4/1993 | Lema |
| 5,203,891 | A | | 4/1993 | Lema |
| 5,207,810 | A | | 5/1993 | Sheth |
| 5,211,427 | A | | 5/1993 | Washizu |
| 5,246,346 | A | | 9/1993 | Schiesser |
| 5,285,123 | A | | 2/1994 | Kataoka et al. |
| 5,306,051 | A | | 4/1994 | Loker et al. |
| 5,337,779 | A | | 8/1994 | Fukuhara |
| 5,378,121 | A | | 1/1995 | Hackett |
| 5,385,446 | A | | 1/1995 | Hays |
| 5,421,708 | A | | 6/1995 | Utter |
| 5,443,581 | A | | 8/1995 | Malone |
| 5,484,521 | A | | 1/1996 | Kramer |
| 5,496,394 | A | | 3/1996 | Nied |
| 5,500,039 | A | | 3/1996 | Mori et al. |
| 5,525,034 | A | | 6/1996 | Hays |
| 5,525,146 | A | | 6/1996 | Straub |
| 5,531,811 | A | | 7/1996 | Kloberdanz |
| 5,538,259 | A | | 7/1996 | Uhrner et al. |
| 5,542,831 | A | | 8/1996 | Scarfone |
| 5,575,309 | A | | 11/1996 | Connell |
| 5,585,000 | A | | 12/1996 | Sassi |
| 5,605,172 | A | | 2/1997 | Schubert et al. |
| 5,628,623 | A | | 5/1997 | Skaggs |
| 5,634,492 | A | | 6/1997 | Steinruck et al. |
| 5,640,472 | A | | 6/1997 | Meinzer et al. |
| 5,641,280 | A | | 6/1997 | Timuska |
| 5,653,347 | A | | 8/1997 | Larsson |
| 5,664,420 | A | | 9/1997 | Hays |
| 5,682,759 | A | | 11/1997 | Hays |
| 5,683,235 | A | | 11/1997 | Welch |
| 5,685,691 | A | | 11/1997 | Hays |
| 5,687,249 | A | | 11/1997 | Kato |
| 5,693,125 | A | | 12/1997 | Dean |
| 5,703,424 | A | | 12/1997 | Dorman |
| 5,709,528 | A | | 1/1998 | Hablanian |
| 5,713,720 | A | | 2/1998 | Barhoum |
| 5,720,799 | A | | 2/1998 | Hays |
| 5,750,040 | A | | 5/1998 | Hays |
| 5,775,882 | A | | 7/1998 | Kiyokawa et al. |
| 5,779,619 | A | | 7/1998 | Borgstrom et al. |
| 5,795,135 | A | | 8/1998 | Nyilas et al. |
| 5,800,092 | A | | 9/1998 | Nill et al. |
| 5,848,616 | A | | 12/1998 | Vogel et al. |
| 5,850,857 | A | | 12/1998 | Simpson |
| 5,853,585 | A | | 12/1998 | Nesseth |
| 5,863,023 | A | | 1/1999 | Evans et al. |
| 5,899,435 | A | | 5/1999 | Mitsch et al. |
| 5,935,053 | A | | 8/1999 | Strid |
| 5,938,803 | A | | 8/1999 | Dries |
| 5,938,819 | A | | 8/1999 | Seery |
| 5,946,915 | A | | 9/1999 | Hays |
| 5,951,066 | A | | 9/1999 | Lane et al. |
| 5,965,022 | A | | 10/1999 | Gould |
| 5,967,746 | A | | 10/1999 | Hagi et al. |
| 5,971,702 | A | | 10/1999 | Afton et al. |
| 5,971,907 | A | | 10/1999 | Johannemann et al. |
| 5,980,218 | A | | 11/1999 | Takahashi et al. |
| 5,988,524 | A | | 11/1999 | Odajima et al. |
| 6,035,934 | A | | 3/2000 | Stevenson et al. |
| 6,059,539 | A | | 5/2000 | Nyilas et al. |
| 6,068,447 | A | | 5/2000 | Foege |
| 6,090,174 | A | | 7/2000 | Douma et al. |
| 6,090,299 | A | | 7/2000 | Hays et al. |
| 6,113,675 | A | | 9/2000 | Branstetter |
| 6,122,915 | A | | 9/2000 | Hays |
| 6,123,363 | A | | 9/2000 | Burgard et al. |
| 6,145,844 | A | | 11/2000 | Waggott |
| 6,149,825 | A | | 11/2000 | Gargas |
| 6,151,881 | A | | 11/2000 | Ai et al. |
| 6,196,962 | B1 | | 3/2001 | Purvey et al. |

6,206,202 B1 3/2001 Galk et al.
6,214,075 B1 4/2001 Filges et al.
6,217,637 B1 4/2001 Toney et al.
6,227,379 B1 5/2001 Nesseth
6,277,278 B1 8/2001 Conrad et al.
6,312,021 B1 11/2001 Thomas
6,314,738 B1 11/2001 Hays
6,372,006 B1 4/2002 Pregenzer et al.
6,375,437 B1 4/2002 Nolan
6,383,262 B1 5/2002 Marthinsen et al.
6,394,764 B1 5/2002 Samurin
6,398,973 B1 6/2002 Saunders et al.
6,402,465 B1 6/2002 Maier
6,426,010 B1 7/2002 Lecoffre et al.
6,464,469 B1 10/2002 Grob et al.
6,467,988 B1 10/2002 Czachor et al.
6,468,426 B1 10/2002 Klass
6,485,536 B1 11/2002 Masters
6,530,484 B1 3/2003 Bosman
6,530,979 B2 3/2003 Firey
6,531,066 B1 3/2003 Saunders et al.
6,537,035 B2 3/2003 Shumway
6,540,917 B1 4/2003 Weinstein et al.
6,547,037 B2 4/2003 Kuzdzal
6,592,654 B2 7/2003 Brown
6,596,046 B2 7/2003 Conrad et al.
6,599,086 B2 7/2003 Soja
6,607,348 B2 8/2003 Jean
6,616,719 B1 9/2003 Sun et al.
6,617,731 B1 9/2003 Goodnick
6,629,825 B2 10/2003 Stickland et al.
6,631,617 B1 10/2003 Dreiman et al.
6,658,986 B2 12/2003 Pitla et al.
6,659,143 B1 12/2003 Taylor et al.
6,669,845 B2 12/2003 Klass
6,688,802 B2 2/2004 Ross et al.
6,707,200 B2 3/2004 Carroll et al.
6,718,955 B1 4/2004 Knight
6,719,830 B2 4/2004 Illingworth et al.
6,764,284 B2 7/2004 Oehman, Jr.
6,776,812 B2 8/2004 Komura et al.
6,802,693 B2 10/2004 Reinfeld et al.
6,802,881 B2 10/2004 Illingworth et al.
6,811,713 B2 11/2004 Arnaud
6,817,846 B2 11/2004 Bennitt
6,837,913 B2 1/2005 Schilling et al.
6,843,836 B2 1/2005 Kitchener
6,878,187 B1 4/2005 Hays et al.
6,893,208 B2 5/2005 Frosini et al.
6,907,933 B2 6/2005 Choi et al.
6,979,358 B2 12/2005 Ekker
7,001,448 B1 2/2006 West
7,013,978 B2 3/2006 Appleford et al.
7,022,150 B2 4/2006 Borgstrom et al.
7,022,153 B2 4/2006 McKenzie
7,025,890 B2 4/2006 Moya
7,033,410 B2 4/2006 Hilpert et al.
7,033,411 B2 4/2006 Carlsson et al.
7,056,363 B2 6/2006 Carlsson et al.
7,063,465 B1 6/2006 Wilkes et al.
7,112,036 B2 9/2006 Lubell et al.
7,131,292 B2 11/2006 Ikegami et al.
7,144,226 B2 12/2006 Pugnet et al.
7,159,723 B2 1/2007 Hilpert et al.
7,160,518 B2 1/2007 Chen et al.
7,169,305 B2 1/2007 Gomez
7,185,447 B2 3/2007 Arbeiter
7,204,241 B2 4/2007 Thompson
7,241,392 B2 7/2007 Maier
7,244,111 B2 7/2007 Suter et al.
7,258,713 B2 8/2007 Eubank et al.
7,270,145 B2 9/2007 Koezler
7,288,202 B2 10/2007 Maier
7,314,560 B2 1/2008 Yoshida et al.
7,323,023 B2 1/2008 Michele et al.
7,328,749 B2 2/2008 Reitz
7,335,313 B2 2/2008 Moya
7,377,110 B2 5/2008 Sheridan et al.
7,381,235 B2 6/2008 Koene et al.
7,396,373 B2 7/2008 Lagerstedt et al.
7,399,412 B2 7/2008 Keuschnigg
7,435,290 B2 10/2008 Lane et al.
7,445,653 B2 11/2008 Trautmann et al.
7,470,299 B2 12/2008 Han et al.
7,473,083 B2 1/2009 Oh et al.
7,479,171 B2 1/2009 Cho et al.
7,494,523 B2 2/2009 Oh et al.
7,501,002 B2 3/2009 Han et al.
7,520,210 B2 4/2009 Theodore, Jr. et al.
7,575,422 B2 8/2009 Bode et al.
7,578,863 B2 8/2009 Becker et al.
7,591,882 B2 9/2009 Harazim
7,594,941 B2 9/2009 Zheng et al.
7,594,942 B2 9/2009 Polderman
7,610,955 B2 11/2009 Irwin, Jr.
7,628,836 B2 12/2009 Baronet et al.
7,637,699 B2 12/2009 Albrecht
7,674,377 B2 3/2010 Crew
7,677,308 B2 3/2010 Kolle
7,708,537 B2 5/2010 Bhatia et al.
7,708,808 B1 5/2010 Heumann
7,744,663 B2 6/2010 Wallace
7,748,079 B2 7/2010 McDowell et al.
7,766,989 B2 8/2010 Lane et al.
7,811,344 B1 10/2010 Duke et al.
7,811,347 B2 10/2010 Carlsson et al.
7,815,415 B2 10/2010 Kanezawa et al.
7,824,458 B2 11/2010 Borgstrom et al.
7,824,459 B2 11/2010 Borgstrom et al.
7,846,228 B1 12/2010 Saaski et al.
2001/0007283 A1 7/2001 Singh et al.
2002/0009361 A1 1/2002 Reichert et al.
2003/0029318 A1 2/2003 Firey
2003/0035718 A1 2/2003 Langston et al.
2003/0136094 A1 7/2003 Illingworth et al.
2004/0007261 A1 1/2004 Cornwell
2004/0170505 A1 9/2004 Lenderink et al.
2005/0173337 A1 8/2005 Costinel
2006/0065609 A1 3/2006 Arthur
2006/0090430 A1 5/2006 Trautman et al.
2006/0096933 A1 5/2006 Maier
2006/0157251 A1 7/2006 Stinessen et al.
2006/0157406 A1 7/2006 Maier
2006/0193728 A1 8/2006 Lindsey et al.
2006/0222515 A1 10/2006 Delmotte et al.
2006/0230933 A1 10/2006 Harazim
2006/0239831 A1 10/2006 Garris, Jr.
2006/0254659 A1 11/2006 Ballot et al.
2006/0275160 A1 12/2006 Leu et al.
2007/0029091 A1 2/2007 Stinessen et al.
2007/0036646 A1 2/2007 Nguyen et al.
2007/0051245 A1 3/2007 Yun
2007/0062374 A1 3/2007 Kolle
2007/0065317 A1 3/2007 Stock
2007/0084340 A1 4/2007 Dou et al.
2007/0140870 A1 6/2007 Fukanuma et al.
2007/0151922 A1 7/2007 Mian
2007/0163215 A1 7/2007 Lagerstadt
2007/0172363 A1 7/2007 Laboube et al.
2007/0196215 A1 8/2007 Frosini et al.
2007/0227969 A1 10/2007 Dehaene et al.
2007/0294986 A1 12/2007 Beetz
2008/0031732 A1 2/2008 Peer et al.
2008/0039732 A9 2/2008 Bowman
2008/0246281 A1 10/2008 Agrawal et al.
2008/0315812 A1 12/2008 Balboul
2009/0013658 A1 1/2009 Borgstrom et al.
2009/0015012 A1 1/2009 Metzler et al.
2009/0025562 A1 1/2009 Hallgren et al.
2009/0025563 A1 1/2009 Borgstrom et al.
2009/0151928 A1 6/2009 Lawson
2009/0159523 A1 6/2009 McCutchen
2009/0169407 A1 7/2009 Yun
2009/0173095 A1 7/2009 Bhatia et al.
2009/0266231 A1 10/2009 Franzen et al.
2009/0304496 A1 12/2009 Maier
2009/0321343 A1 12/2009 Maier
2009/0324391 A1 12/2009 Maier

| | | | |
|---|---|---|---|
| 2010/0007133 | A1 | 1/2010 | Maier |
| 2010/0021292 | A1 | 1/2010 | Maier et al. |
| 2010/0038309 | A1 | 2/2010 | Maier |
| 2010/0043288 | A1 | 2/2010 | Wallace |
| 2010/0043364 | A1 | 2/2010 | Curien |
| 2010/0044966 | A1 | 2/2010 | Majot et al. |
| 2010/0072121 | A1 | 3/2010 | Maier |
| 2010/0074768 | A1 | 3/2010 | Maier |
| 2010/0083690 | A1 | 4/2010 | Sato et al. |
| 2010/0090087 | A1 | 4/2010 | Maier |
| 2010/0143172 | A1 | 6/2010 | Sato et al. |
| 2010/0163232 | A1 | 7/2010 | Kolle |
| 2010/0183438 | A1 | 7/2010 | Maier et al. |
| 2010/0239419 | A1 | 9/2010 | Maier et al. |
| 2010/0239437 | A1 | 9/2010 | Maier |
| 2010/0247299 | A1 | 9/2010 | Maier |
| 2010/0257827 | A1 | 10/2010 | Lane et al. |
| 2011/0017307 | A1 | 1/2011 | Kidd et al. |
| 2011/0061536 | A1 | 3/2011 | Maier et al. |

FOREIGN PATENT DOCUMENTS

| | | | |
|---|---|---|---|
| EP | 301285 | | 10/1991 |
| EP | 1582703 | | 10/2005 |
| EP | 2013479 | | 1/2009 |
| EP | 7838631.5 | | 12/2009 |
| GB | 2323639 | | 9/1998 |
| GB | 2337561 | | 11/1999 |
| JP | 54099206 | | 1/1978 |
| JP | 08 068501 | | 3/1996 |
| JP | 8-284961 | A | 11/1996 |
| JP | 2002 242699 | | 8/2002 |
| JP | 2004034017 | A | 2/2004 |
| JP | 3711028 | | 10/2005 |
| JP | 2005291202 | | 10/2005 |
| KR | 2009085521 | | 2/2008 |
| MX | 2008012579 | | 12/2008 |
| WO | 9524563 | | 9/1995 |
| WO | 0117096 | | 3/2001 |
| WO | 2007043889 | | 4/2007 |
| WO | 2007103248 | | 9/2007 |
| WO | 2007120506 | | 10/2007 |
| WO | 2008036221 | | 3/2008 |
| WO | 2008039446 | | 3/2008 |
| WO | 2008039491 | | 4/2008 |
| WO | 2008039731 | | 4/2008 |
| WO | 2008039732 | | 4/2008 |
| WO | 2008039733 | | 4/2008 |
| WO | 2008039734 | | 4/2008 |
| WO | 2008036394 | | 7/2008 |
| WO | 2009111616 | | 9/2009 |
| WO | 2009158252 | | 12/2009 |
| WO | 2009158253 | | 12/2009 |
| WO | 2010083416 | | 7/2010 |
| WO | 2010083427 | | 7/2010 |
| WO | 2010107579 | | 9/2010 |
| WO | 2010110992 | | 9/2010 |
| WO | 2011034764 | | 3/2011 |

OTHER PUBLICATIONS

PCT/US2007/008149 International Search Report and Written Opinion dated Jul. 17, 2008.
PCT/US2007/020101 International Preliminary Report on Patentability dated Apr. 2, 2009.
PCT/US2007/020101 International Search Report dated Apr. 29, 2008.
PCT/US2007/020101 Written Opinion dated Mar. 19, 2009.
PCT/US2007/020471 International Preliminary Report on Patentability dated Apr. 2, 2009.
PCT/US2007/020471 International Search Report and Written Opinion dated Apr. 1, 2008.
PCT/US2007/020659 International Preliminary Report on Patentability dated Mar. 31, 2009.
PCT/US2007/020659 International Search Report and Written Opinion dated Sep. 17, 2008.
PCT/US2007/020768 International Preliminary Report on Patentability dated Mar. 31, 2009.
PCT/US2007/020768 International Search Report and Written Opinion dated Mar. 3, 2008.
PCT/US2007/079348 International Preliminary Report on Patentability dated Mar. 31, 2009.
PCT/US2007/079348 International Search Report dated Apr. 11, 2008.
PCT/US2007/079348 Written Opinion dated Jan. 25, 2008.
PCT/US2007/079349 International Preliminary Report on Patentability dated Mar. 31, 2009.
PCT/US2007/079349 International Search Report and Written Opinion dated Apr. 2, 2008.
PCT/US2007/079350 International Preliminary Report on Patentability dated Mar. 31, 2009.
PCT/US2007/079350 International Search Report dated Jul. 17, 2008.
PCT/US2007/079350 Written Opinion dated Mar. 25, 2009.
PCT/US2007/079352 International Preliminary Report on Patentability dated Mar. 31, 2009.
PCT/US2007/079352 International Search Report and Written Opinion dated Aug. 27, 2008.
PCT/US2009/036142 International Preliminary Report on Patentability dated Sep. 16, 2010.
PCT/US2009/036142 International Search Report dated Jan. 7, 2010.
PCT/US2009/036142 Written Opinion dated May 11, 2009.
PCT/US2009/047662 International Preliminary Report on Patentability dated Jan. 13, 2011.
PCT/US2009/047662 Written Opinion dated Aug. 20, 2009.
PCT/US2010/021199 International Search Report and Written Opinion dated Mar. 22, 2010.
PCT/US2010/021199 International Preliminary Report on Patentability dated Mar. 29, 2011.
PCT/US2010/021218 International Search Report and Written Opinion dated Mar. 23, 2010.
PCT/US2010/021218 International Report on Patentability dated Feb. 2, 2011.
PCT/US2010/025650 International Search Report and Written Opinion dated Apr. 22, 2010.
PCT/US2010/025650 International Report on Patentability dated Mar. 14, 2011.
PCT/US2010/025952 International Search Report and Written Opinion dated Apr. 12, 2010.
PCT/US2010/025952 International Report on Patentability dated Mar. 14, 2011.
PCT/US2009/047667 International Report on Patentability dated Jan. 13, 2011.
PCT/US2009/047667 Written Opinion dated Aug. 7, 2009.
PCT/US2009/047667 International Search Report dated Dec. 30, 2009.
Dresser-Rand, Inc. "High Pressure Air Compressor Model 13NL45," Oct. 28, 1991, 14 pages.
Technical Manual—High Pressure Air Compressor Model 13NL45; Navsea S6220-AT-MMA-010/93236, pp. 3-23 to 3-32, Electric Boat Corporation, Groton, CT 06340, Oct. 28, 1991.

* cited by examiner

SLIDABLE COVER FOR CASING ACCESS PORT

BACKGROUND

The present disclosure relates to fluid machinery, and more particularly to high pressure casings for such machinery.

Fluid machinery, such as centrifugal compressors, typically include a casing for containing working components, such as one or more impellers mounted on a rotatable shaft. The casing includes one or more inlets for directing fluid inwardly toward the compressor working components and one or more outlets for directing pressurized fluid outwardly from the casing for subsequent processing or ultimate usage. Further, compressor casings often include one or more openings to provide access to maintain or repair components of the compressor, for example, shaft bearings, etc. Such access openings must be closed by a hatch or cover during normal compressor use.

Since a variety of compressors are operated at relatively high pressure, the access covers are required to resist this high pressure, and are therefore often relatively thick, require the machining of a protrusion for mounting the cover, and are typically secured by a relatively large number of fasteners or bolts. Since these compressors may operate in hostile environments such as subsea applications, the cover bolts could be subject to deterioration, which may lead to failure of the entire compressor.

SUMMARY

Embodiments of the disclosure may provide a closure device having at least one access opening. The closure device may include a cover member movably disposed within an interior chamber of the casing so as to be slidably displaceable along a central axis between an open and a closed position, the cover member being spaced at least partially axially from the access opening in the open position so as to permit access to the interior chamber and generally extending across and substantially obstructing the at least one access opening in the closed position. Further, the cover member may generally extend across and substantially obstructs the access opening in the closed position.

Embodiments of the disclosure may further provide a compressor casing assembly. The casing assembly may include a casing having a central axis, an inner surface defining an interior chamber, an opposing outer surface, and at least one access opening extending generally radially between the casing inner and outer surfaces, and a closure device including a cover member movably disposed within the interior chamber so as to be slidably displaceable generally along the central axis between an open and a closed position, the cover member being spaced at least partially axially from the access opening in the open position so as to permit access to the interior chamber and generally extends across and substantially obstructs the access opening in the closed position.

Embodiments of the disclosure may further provide a closure device for a high pressure compressor casing, the casing having a central axis, an inner surface defining an interior chamber, an opposing outer surface, and an access opening extending between the casing inner and outer surfaces. The closure device may include a retainer body disposed within the casing interior chamber generally adjacent to the access opening and having a central bore. A cover member is movably disposed within the central bore of the retainer body so as to be slidably displaceable generally along the casing central axis between an open and a closed position. The cover member is spaced at least partially axially from the access opening in the open position so as to permit access to the interior chamber and generally extends across and substantially obstructs the access opening in the closed position.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
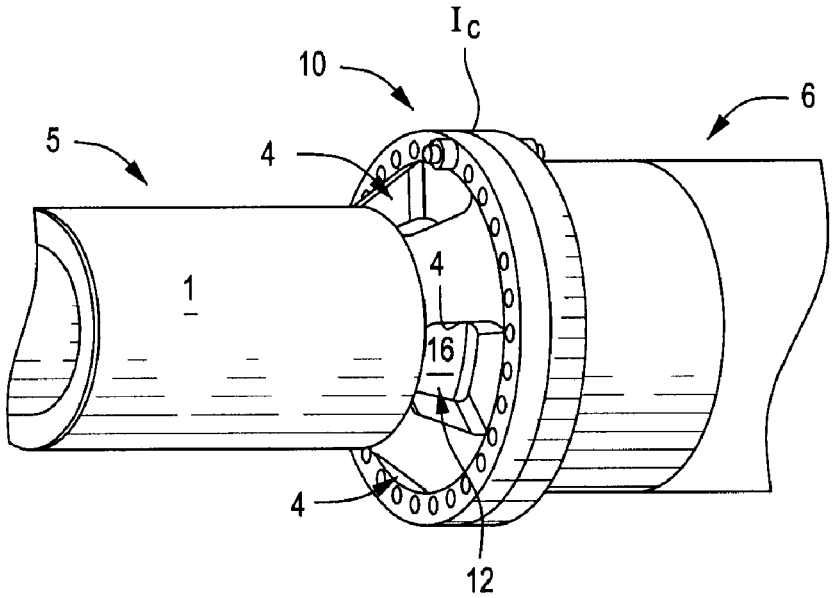
FIG. 1 is a partly broken-away, perspective view of a compressor assembly having a closure device in accordance with one or more aspects of the present disclosure.
Figure 2:
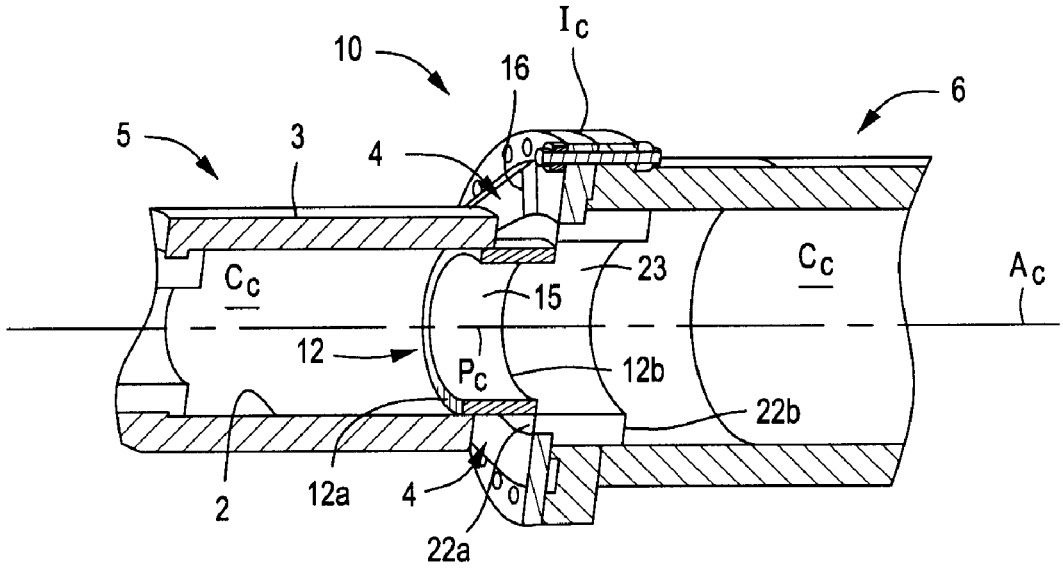
FIG. 2 is a partly broken-away, perspective view of an axial cross-section through the compressor casing and closure device, shown without internal compressor and drive components according to one or more aspects of the present disclosure.

It is to be understood that the following disclosure describes several exemplary embodiments for implementing different features, structures, or functions of the invention. Exemplary embodiments of components, arrangements, and configurations are described below to simplify the present disclosure, however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope.

FIGS. 1-5 illustrate a closure device 10 for a turbomachine casing 1. In an exemplary embodiment, the turbomachine may include a high-pressure compressor. The casing 1 may include a central axis $A_C$, an inner surface 2 that defines an interior chamber $C_C$, an opposing outer surface 3, and at least one access opening 4, each extending generally radially between the casing inner and outer surfaces 2, 3. The closure device 10 may include an at least partially arcuate cover member 12 movably disposed within the casing interior chamber $C_C$ so as to be slidably displaceable generally along, and in the direction of the central axis $A_C$ between open and closed positions $P_O$ and $P_C$, respectively. The cover member 12 is spaced at least partially axially from the access opening(s) 4 in the open position $P_O$ (FIG. 4) so as to permit access to the casing interior chamber $C_C$. Further, the cover member 12 generally extends across and substantially obstructs the one or more access openings 4 in the closed position $P_C$.

In an exemplary embodiment, the plurality of casing access openings 4 may be spaced circumferentially about the central axis $A_C$, and spaced in generally equal angular increments that are generally axially aligned. However, the casing openings 4 may alternatively be unevenly angularly spaced and/or axially spaced apart, or the casing 1 may include only a single opening 4. In any of these cases, the cover member 12 is configured (e.g., sized and shaped, etc.) so as to extend across and completely cover all of the plurality of access openings 4 in the closed position $P_C$. Further, each opening 4 may be generally rectangular and have two circumferential edges 4*a*, 4*b* and axial edges 4*c*, 4*d*, one circumferential edge 4*a* being located proximal to a casing section inner end 5*a*, as discussed in further detail below.

More specifically, the cover member 12 may include an annular body extending circumferentially about the central axis $A_C$ and may have opposing axial ends 12*a*, 12*b*, a central bore 15 extending between the two ends 12*a*, 12*b*, and an outer circumferential surface 16 extending axially between the ends 12*a*, 12*b*. The central bore 15 is sized to receive compressor components, such as a section of a main compressor shaft, shaft bearings, etc. (none shown), with clearance, such that the shaft is rotatable within the body and the body is axially displaceable along the shaft. The outer surface 16 is disposeable against section 2*a* of the casing inner circumferential surface(s) 2 adjacent to the access openings 4, such that the outer surface 16 generally seals against such adjacent surface section 2*a* of the casing 1, such sealing being assisted by radially-outward expansion of the body when subjected to high operating pressures inside the casing. Thereby, the cover member 12 seals or substantially prevents fluid flow through the one or more access openings 4.

Due to the fact that the cover outer surface 16 seals radially outwardly against the casing inner surface 2, the cover member 12 is located radially or diametrically inward of the casing 1 and is thus subjected to lesser stress (e.g., hoop shear) generated by high pressure fluid in the interior chamber $C_C$ in comparison with the casing 1. Also, the cover member 12 is at least partially supported by the casing sections against which the body outer surface 16 seals. For these reasons, the cover member 12 may be formed with a lesser thickness ($t_M$) in comparison with the casing thickness ($t_C$), as indicated in FIG. 5.

Although the cover member 12 may include a one-piece annular body, it may alternatively be formed of a generally arcuate body (not illustrated) having at least a partially circumferential surface. In an alternative exemplary embodiment, the cover member 12 may be formed with a generally rectangular or other polygonal or complex-shaped tubular body shaped to match a corresponding shape of the casing inner surface 1.

Figure 5:
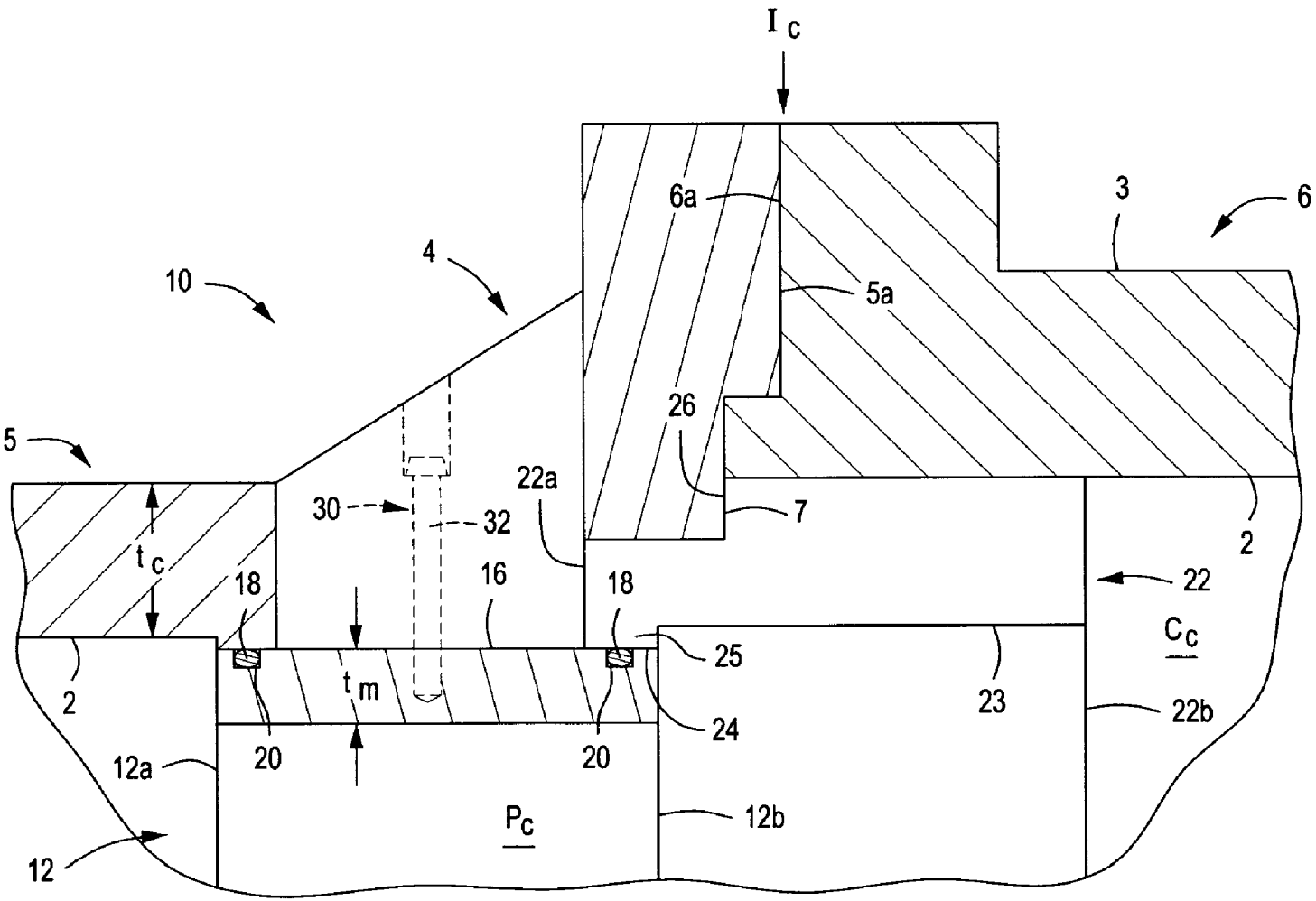
FIG. 5 is an enlarged view of a portion of the compressor assembly and cover member of FIG. 3, according to one or more aspects of the present disclosure.

Referring particularly to FIG. 5, the closure device 10 may further include a pair of generally annular sealing members 18 each disposed in a separate groove 20, the two grooves 20 being disposed on opposing axial sides of the one or more casing openings 4. Each sealing member 18 is configured to prevent fluid flow generally between the cover member outer surface 16 and the casing inner surface 2, thereby substantially preventing fluid from exiting the casing interior chamber $C_C$ to the atmosphere. In an exemplary embodiment, each groove 20 may extend radially inwardly from the outer surface 16, such that the sealing members 18 seal against the casing inner surface 2 and are axially movable with the cover member 12. However, the grooves 20 may alternatively extend radially outwardly from the casing inner surface 2 such that the sealing members 18 are generally immovable relative to the displaceable cover member body and seal against the cover member outer surface 16. Furthermore, each sealing member 18 may be a commercially-available elastomeric ring, such as an O-ring, but may include any other appropriate sealing device.

Referring now to FIGS. 2-5, the closure device 10 may include a generally annular retainer body or retainer 22 disposed within the casing interior chamber $C_C$ generally adjacent to the access openings 4 at a generally fixed position on the central axis $A_C$. In an exemplary embodiment, the retainer 22 may be an integral component of a second casing section 6, thus eliminating a high pressure seal between casing 5 and casing 6.

More specifically, the retainer 22 may have opposing first and second axial ends 22*a*, 22*b* and may be located such that the first end 22*a* is located generally aligned with the outer circumferential edge 4*a* of each access opening 4. Further, the retainer 22 may be configured to retain the cover member 12 so as to limit axial movement of the member 12 between the open and closed positions $P_O$ and $P_C$. Although not illustrated, an axial stop may be provided to limit the axial range of motion of the cover member 12. In one embodiment, the axial stop may include a radially outward projection on the cover member 12 or alternatively may include a radially inward projection on the retainer 22 or the inner surface of the casing section 5. In an exemplary embodiment, the projection could be a turned step or a radial bolt.

Specifically, the retainer 22 may have a central bore 23 configured to receive the cover member 12 such that at least a portion of the cover member 12 is or remains disposed within the central bore 23 in both the open and closed positions $P_O$ and $P_C$, so that the cover member 12 and the retainer 22 may be always coupled together. Furthermore, the retainer 22 may also provide an internal bearing surface 24 against which the cover member outer surface 16 may slide during displacement between the open and closed positions $P_O$, $P_C$, as best shown in FIG. 5. In an exemplary embodiment, the bearing surface 24 may be provided on an annular shoulder 25 that extends radially-inwardly with respect to a remainder of the bore 23, but may alternatively be provided by the entire bore 23 inner surface if formed without a shoulder (not illustrated).

As the compressor casing 1 may include a two-piece construction as described below, the retainer 22 may also serve as an "adapter" in the sense that the provided bearing surface 26 may be spaced radially inward as compared with the inner surface of a second casing section 6. In an exemplary embodiment, the cover member 12 may be located primarily within the casing section 6 in the open position $P_O$, as described below.

In an exemplary embodiment of the present disclosure, the casing 1 may further have a generally radial shoulder surface 7 facing generally away from the access opening(s) 4 and the retainer body 22 may have a generally radial contact surface 26 disposed against the casing shoulder surface 7 so as to locate the coupled cover member 12 to move between the desired positions $P_O$ and $P_C$. The shoulder surface 7 may also prevent axial displacement of the retainer 22 in a direction generally toward the access openings 4, thereby avoiding the potential for the retainer 22 from "dislodging" and displacing along, or in the direction of the axis $A_C$ to a position where the one of more access openings 4 are obstructed.

Figure 3:
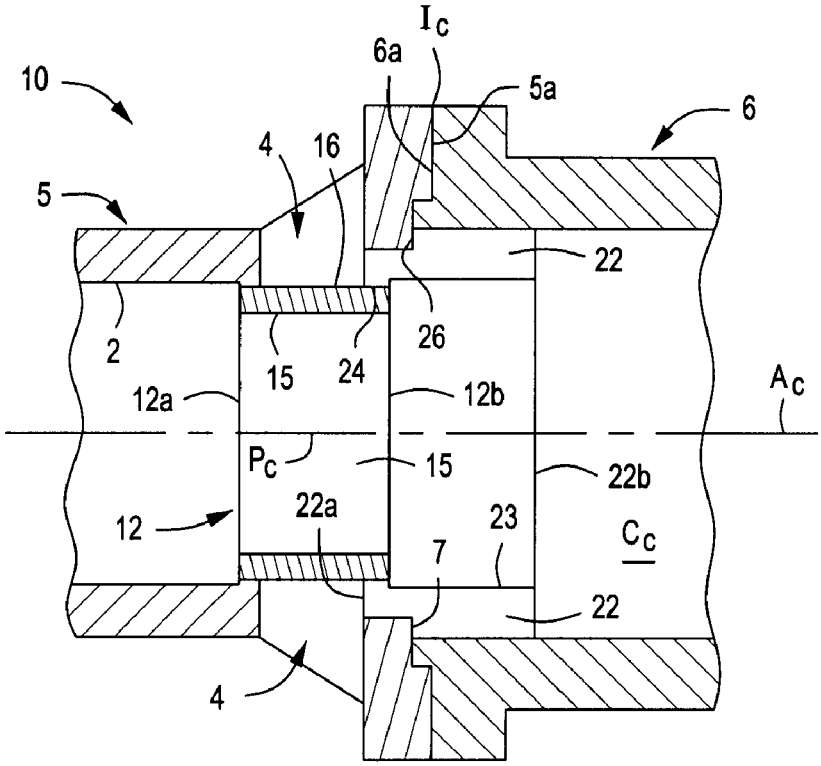
FIG. 3 is an axial cross-sectional view of the compressor casing and closure device, showing a cover member in an open position according to one or more aspects of the present disclosure.
Figure 4:
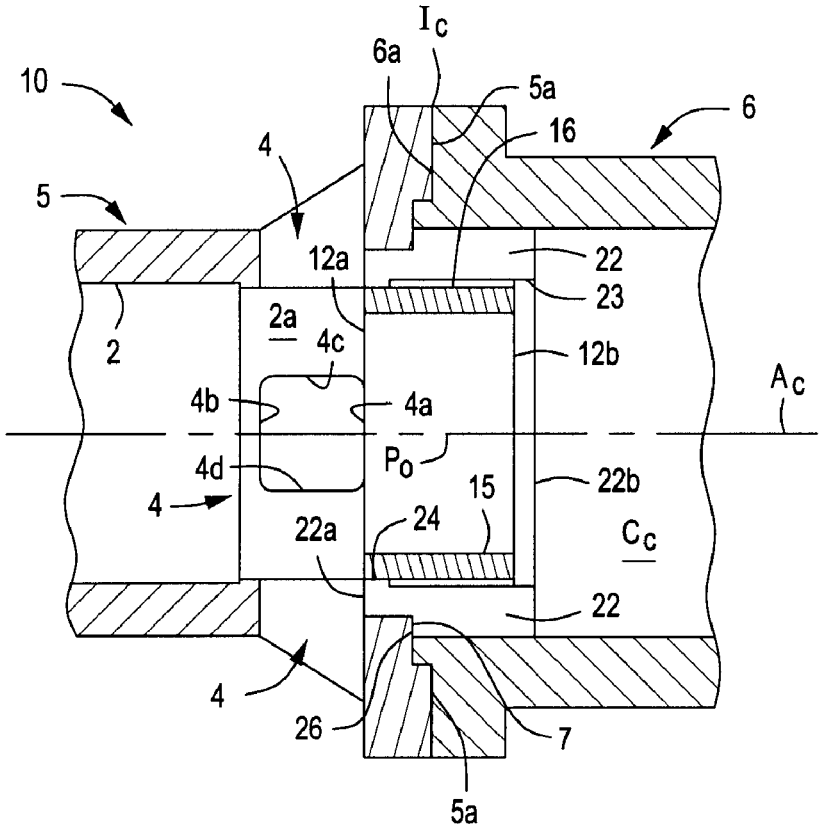
FIG. 4 is another axial cross-sectional view of the compressor casing and closure device, showing a cover member in a closed position according to one or more aspects of the present disclosure.

Referring again to FIGS. 1-5, the casing 1 may be constructed of two-piece construction and include first and second casing sections 5, 6 coupled at a casing interface $I_C$ and each encompassing a portion of the casing interior chamber $C_C$. More specifically, as illustrated in FIGS. 3-5, each casing section 5, 6 may include an inner end 5*a*, 6*a*, respectively. In one embodiment, inner end 5*a* may be releasably coupled to opposing inner end 6*a* in a variety of configurations, e.g., a plurality of bolts, clamp ring segments, etc., so as to permit separation of the two casing sections 5, 6. The first casing section 5 may be particularly formed or adapted to enclose the working components of a centrifugal compressor assembly (e.g., impellers, diffuser channels, etc.) and the second casing section 6 may be designed/adapted to enclose the components of a driver (e.g., an electric motor). As such, a shaft assembly may extend through the central bores 15, 23 of both the cover member 12 and the retainer 22 and across the interface $I_C$, with the cover member 12 being axially displaceable without interference with/by the compressor components, as discussed above.

In an exemplary embodiment, the first casing section 5 may include the one or more access openings 4 and the retainer member 22 may be disposed within the second casing section 6 generally adjacent to the casing section inner end 6*a*, with the cover member 12 being movable across the interface $I_C$. That is, the cover member 12 may be disposed substantially within the second casing section 6 in the open position $P_O$ and may be at least partially disposed within the first casing section 5 in the closed position $P_C$. Further, the casing first section 5 may include the shoulder surface 7, which may be spaced axially inwardly from the casing section first end 5*a*. As such, when the retainer 22 is positioned with the radial retainer contact surface 26 disposed against the casing shoulder surface 7, the retainer 22 may be partially disposed within the first casing section 5 and thus extend across the interface $I_C$, thereby serving to increase the structural integrity of the casing 1 at the interface $I_C$.

Referring particularly to FIG. 5, the closure device 10 may include at least one connector 30 configured to releasably retain the cover member 12 disposed in the closed position $P_C$. The connector(s) 30 may each include a bolt 32 extending generally radially through the casing 1 and the cover member 12, a circumferential retainer ring (not illustrated) disposed adjacent to an axial end of the cover member 12, or any other appropriate device or mechanism for releasably securing the cover member 12 in the closed position $P_C$. As the cover body 12 seals against the inner surface of the casing 2 (in some embodiments, a section of the retainer 22), the connector(s) 30 may only be required to maintain the cover member 12 in position when the compressor 1 is not in use and is not required to "resist" the relatively high operating pressures of the compressor 1, as is the case with externally-mounted access covers.

In an alternative exemplary embodiment, the cover member 12 may be manually moveable (i.e., when pressure in the chamber $C_C$ is at ambient pressure) between the open and closed positions $P_O$, $P_C$, such that the body 12 may be pushed or pulled by a compressor operator or maintenance person when it is desired to access the interior chamber $C_C$ through the openings 4. However, the closure device 10 may alternatively include an actuator or mechanism (not shown) configured to displace the cover member 12 between the two positions $P_O$, $P_C$, such as for example, a threaded rod and nut mechanism, a motor driven spindle, a hydraulic cylinder, etc.

Although the closure device 10 of the present disclosure is specifically described and depicted as being used in a high-pressure casing of a centrifugal compressor assembly, the closure device 10 may be used with any other high or low pressure casing assembly, such as for example, a low pressure centrifugal compressor, a reciprocating compressor or any other type of fluid machinery.

The foregoing has outlined features of several embodiments so that those skilled in the art may better understand the detailed description that follows. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. A closure device for a casing having at least one access opening, comprising:

a cover member movably disposed within an interior chamber of the casing so as to be slidably displaceable in the direction of a casing central axis between an open and a closed position, the cover member being spaced at least partially axially from the access opening in the open position so as to permit access to the interior chamber and generally extending across and substantially obstructing the at least one access opening in the closed position, wherein the cover member includes a body extending circumferentially about the casing central axis; and a retainer body disposed within the interior chamber adjacent to the access opening and forming a central bore configured to receive the cover member such that at least a portion of the cover member is disposed within the central bore in both the open and closed positions.

2. The closure device as recited in claim 1, wherein the casing has a plurality of access openings spaced circumferentially about the casing central axis, the cover member being configured to extend substantially across all of the plurality of access openings in the closed position.

3. The closure device as recited in claim 1, wherein:

the body has opposing axial ends with an outer circumferential surface extending axially between the opposing axial ends and having at least one groove extending radially inward from the outer circumferential surface; and at least one sealing member is disposed in the at least one groove and configured to prevent fluid flow generally between the outer circumferential surface and the interior chamber of the casing.

4. The closure device as recited in claim 1, wherein:

the body has opposing axial ends with an outer circumferential surface extending axially between the opposing axial ends;

the interior chamber of the casing has at least one groove substantially adjacent to the body and extending radially outward from body; and at least one sealing member is disposed in the at least one groove and configured to prevent fluid flow generally between the outer circumferential surface and the interior chamber of the casing.

5. The closure device as recited in claim 1, wherein the casing has a shoulder surface facing generally away from the access opening and the retainer body has a contact surface disposed against the shoulder surface so as to prevent axial displacement of the retainer body in a direction generally toward the access opening.

6. The closure device as recited in claim 1, further comprising at least one connector configured to releasably retain the cover member disposed in the closed position.

7. The closure device as recited in claim 6, wherein the connector includes one of a bolt extending generally radially through the casing and the cover member, and a circumferential retainer ring disposed adjacent to an axial end of the cover member.

8. A compressor casing assembly comprising:

a casing having a central axis, an inner surface defining an interior chamber, an opposing outer surface, and at least one access opening extending generally radially between the casing inner and outer surfaces; and a closure device including a cover member movably disposed within the interior chamber so as to be slidably displaceable generally along or in the direction of the central axis between an open and a closed position, the cover member being spaced at least partially axially from the access opening in the open position so as to permit access to the interior chamber and generally extending across and substantially obstructing the access opening in the closed position, wherein the casing includes first and second casing sections, each of the first and second sections having an inner end, wherein the inner end of the first casing section is connected with the inner end of the second casing section, the first casing section including the at least one access opening and the cover member being disposed substantially within the second casing section in the open position and at least partially disposed within the first casing section in the closed position; and a retainer body at least partially disposed within the second casing section and generally adjacent to the second casing section inner end, the retainer body defining a central bore configured to receive the cover member such that at least a portion of the cover member is disposed within the central bore in both the open and closed positions.

9. The casing assembly as recited in claim 8, wherein the first casing section has a shoulder surface facing generally away from the access opening and the retainer body is partially disposed within the first casing section and has a contact surface disposed against the shoulder surface of the first casing section so as to prevent axial displacement of the retainer body in a direction generally toward the access opening.

10. The casing assembly as recited in claim 8, wherein the inner ends of the first and second casing sections are releasably connected so as to permit separation of the first and second casing sections.

11. The casing assembly as recited in claim 8, wherein the cover member includes a generally annular body extending circumferentially about the central axis.

12. The casing assembly as recited claim 11, wherein the casing has a plurality of access openings spaced circumferentially about the central axis, the cover member being configured to extend substantially across the plurality of access openings in the closed position.

13. The casing assembly as recited in claim 1, wherein:

the annular body has opposing axial ends and an outer circumferential surface extending axially between the opposing axial ends; and the closure device further comprises a pair of generally annular sealing members each disposed in a separate groove either extending radially outward from the casing inner surface or radially inward from the outer circumferential surface of the annular body, wherein each sealing member is configured to prevent fluid flow generally between the outer circumferential surface and the casing inner surface.

14. A closure device for a turbomachine casing having at least one access opening, comprising:

a retainer body disposed within an interior chamber of the casing and generally adjacent to the at least one access opening, wherein the retainer body defines a central bore; and a cover member movably disposed within the central bore so as to be slidably displaceable along or in the direction of a casing central axis of the casing between an open and a closed position, the cover member being spaced at least partially axially from the at least one access opening in the open position so as to permit access to the interior chamber and generally extending across and substantially obstructing the at least one access opening in the closed position.

15. The closure device as recited in claim 14, wherein:

the cover member includes an annular body having opposing axial ends and an outer circumferential surface extending axially between the opposing axial ends; and the closure device further comprises a pair of generally annular sealing members each disposed in a separate groove either extending radially outward from the interior chamber of the casing or radially inward from the outer circumferential surface of the annular body, wherein each sealing member is configured to prevent fluid flow generally between the outer circumferential surface and the interior chamber of the casing.

16. The closure device as recited in claim 14, wherein the casing has a shoulder surface facing generally away from the at least one access opening and the retainer body has a contact surface disposed against the shoulder surface so as to prevent axial displacement of the retainer body in a direction generally toward the at least one access opening.

17. The closure device as recited in claim 14, wherein the casing includes first and second casing sections, each section having an inner end connected with the inner end of the other casing section, the first casing section including the at least one access opening and the retainer body being at least partially disposed within the second casing section, wherein the cover member is disposed substantially within the second casing section in the open position and at least partially disposed within the first casing section in the closed position.

* * * * *